US012669056B2

(12) United States Patent
Chang

(10) Patent No.: US 12,669,056 B2
(45) Date of Patent: Jun. 30, 2026

(54) ROTARY STEAM ENGINE

(71) Applicants: Shih-Ho Chang, Changhua City (TW); Han-Chih Chang, Changhua City (TW); Hsin-Yu Chang, Changhua City (TW)

(72) Inventor: Shih-Ho Chang, Changhua City (TW)

(73) Assignees: Shih-Ho Chang, Changhua City (TW); Han-Chih Chang, Changhua City (TW); Hsin-Yu Chang, Changhua City (TW)

( * ) Notice: Subject to any disclaimer, the term of this patent is extended or adjusted under 35 U.S.C. 154(b) by 177 days.

(21) Appl. No.: 18/809,973

(22) Filed: Aug. 20, 2024

(65) Prior Publication Data

US 2026/0055707 A1 Feb. 26, 2026

(51) Int. Cl.
*F01B 1/06* (2006.01)
*F01B 31/26* (2006.01)

(52) U.S. Cl.
CPC ..... *F01B 31/26* (2013.01); *F01B 1/06* (2013.01)

(58) Field of Classification Search
CPC .... F04B 1/04–0404; F04B 29/12; F01B 1/06; F01B 1/0641; F01B 17/04; F01B 31/26; F01B 3/04; F01B 3/0032; F01B 9/06; F01K 7/36
USPC ..... 91/491; 60/227; 123/44 D
See application file for complete search history.

(56) References Cited

U.S. PATENT DOCUMENTS 944,913 A * 12/1909 Rogers ..... F04B 1/053 91/496
996,543 A * 6/1911 Vincent ..... F04B 1/053 417/457
1,157,811 A * 10/1915 Shannon ..... F02B 57/08 91/496
2,018,306 A * 10/1935 Hunt ..... F02B 57/08 123/226
2,350,683 A * 6/1944 Leopold ..... F03C 1/0444 91/496

(Continued)

FOREIGN PATENT DOCUMENTS

BR PI0520762 A2 * 5/2009 ..... F01B 9/06
CA 2308129 A1 * 12/2000 ..... F01B 9/06

(Continued)

*Primary Examiner* — Thomas Fink
(74) *Attorney, Agent, or Firm* — MUNCY, GEISSLER, OLDS & LOWE, P.C.

(57) ABSTRACT

A rotary steam engine includes: a stator mechanism including two stators forming a track therebetween; a rotor rotatably arranged between the stators and including cylinders and perorations open on an outer surface of the rotor and communicating with the cylinders; a mandrel disposed through the stator mechanism and the rotor; pistons respectively received in the cylinders and respectively including piston shafts movable along the track, an engine lubricating system being formed between the cylinders, pistons and stators; and gas covers radially movable, resiliently disposed on the stator mechanism and covered on the rotor; wherein when a gas injection space between the gas cover and the rotor communicating with the perorations, steam can flow to enter the cylinders to drive the pistons; wherein when the gas injection space is not in communication with the perorations, the pistons move to discharge steam in the cylinders via the perorations.

9 Claims, 13 Drawing Sheets

(56) References Cited

U.S. PATENT DOCUMENTS

| | | | | | |
|---|---|---|---|---|---|
| 2,389,709 | A * | 11/1945 | Anders | F01B 1/0668 | 91/496 |
| 3,568,645 | A * | 3/1971 | Grimm | F01C 1/3446 | 418/264 |
| 4,057,367 | A * | 11/1977 | Moe | F04B 39/0016 | 417/273 |
| 5,636,599 | A * | 6/1997 | Russell | F02B 57/10 | 123/54.1 |
| 5,701,930 | A * | 12/1997 | Russell | F01L 1/04 | 123/189 |
| 6,230,670 | B1 * | 5/2001 | Russell | F02B 63/04 | 123/44 E |
| 7,984,702 | B2 * | 7/2011 | Russell | F02P 13/00 | 123/162 |
| 8,113,165 | B2 * | 2/2012 | Russell | F01B 1/0603 | 123/56.7 |
| 8,225,753 | B2 * | 7/2012 | Sorrels | F01B 9/06 | 123/44 C |
| 8,316,817 | B2 * | 11/2012 | Rucker | F02B 57/08 | 123/44 C |
| 10,527,007 | B2 * | 1/2020 | Russell | F01B 1/0624 | |
| 11,697,993 | B1 * | 7/2023 | Chang | F02B 57/08 | 123/200 |
| 2009/0194071 | A1 * | 8/2009 | Sorrels | F01B 9/06 | 123/45 R |

FOREIGN PATENT DOCUMENTS

| | | | | |
|---|---|---|---|---|
| GB | 190810263 | A * | 10/1908 | F04B 1/1133 |
| GB | 667830 | A * | 3/1952 | F04B 27/06 |

* cited by examiner

ROTARY STEAM ENGINE

BACKGROUND OF THE INVENTION

Field of the Invention

The present invention relates to an engine, and more particularly, to a rotary steam engine.

Description of the Prior Art

Nowadays, engines play an important role in various fields such as transportation, industrial machinery, and other power-demanding areas. Conventional engines operate through the cooperation of components such as cylinders, pistons, crankshafts, and valves. In conventional internal or external combustion engines, they achieve a complete power cycle by undergoing several strokes.

The invention of the steam engine in the 18th century initiated the first industrial revolution, leading humanity into an era of mechanized production. This highlights the importance of steam engines in human civilization. However, traditional steam engines operate with a reciprocating motion mechanism, making their structure and manufacturing extremely complex and significantly reducing their thermal conversion efficiency, thus resulting in their obsolescence.

Although conventional steam engines have been phased out, the characteristic of steam expanding 1700 times upon vaporization keeps steam power relevant in industries today. For instance, steam turbines are used in nuclear, thermal and geothermal power generation to convert thermal energy into electrical energy. However, steam turbines use steam in an open manner, failing to effectively utilize the pressure generated by steam's significant expansion, which results in low thermal efficiency.

With the advent of the artificial intelligence (AI) era, there is an urgent need for a large power source. Thus, providing an advanced, simple-structured steam-powered generation device with significantly improved thermal efficiency has become the most critical issue.

The present invention is, therefore, arisen to obviate or at least mitigate the above-mentioned disadvantages.

SUMMARY OF THE INVENTION

The main object of the present invention is to provide a rotary steam engine which uses the significant volume change of liquid water vaporization as the power source, offering excellent performance and providing the industry with a highly efficient power source.

To achieve the above and other objects, a rotary steam engine is provided, wherein the rotary steam engine includes: a stator mechanism including two stators and two stator seals, each of the two stators including an annular guide groove and two stator grooves extending radially inside and outside the annular guide groove, the annular guide grooves of the two stators axially corresponding to each other to form a track, the two stator seals being embedded in and clamped between the annular guide grooves of the two stators; a rotor rotatably arranged between the two stators and including a plurality of cylinders and a plurality of perorations, a cylinder wall of each cylinder including a plurality of slots, the plurality of perorations being open on an outer circumferential surface of the rotor and respectively in communication with interiors of the plurality of cylinders; a mandrel including a plurality of axial ventilation grooves corresponding to the plurality of cylinders, disposed through the stator mechanism and the rotor, and movable with the rotor; a plurality of pistons, each of upper and lower ends of each of the plurality of pistons including a piston seal, the plurality of pistons being respectively received in the plurality of cylinders and respectively including piston shafts which project axially beyond the plurality of slots and are movable along the track, a space in which each of the plurality of pistons and the piston seal are movable in the cylinder, a space between the two stator seals of the stator mechanism and the plurality of slots being in communication with one another to form an engine lubricating system; and a plurality of gas covers radially movable respectively, resiliently disposed on the stator mechanism and covered on an outer circumferential surface of the rotor, a gas injection space being formed between each gas cover and the outer circumferential surface of the rotor, each of the plurality of gas covers including a gas supplying passage in communication with the gas injection space and configured for entering steam; wherein when the gas injection space is in communication with the plurality of perorations, the steam enters the gas injection space via the gas supplying passage of each of the plurality of gas covers and enters the plurality of cylinders via the plurality of perorations to drive the plurality of pistons to move radially inward so that the rotor rotates relative to the stator mechanism; wherein when the gas injection space is not in communication with the plurality of perorations, the piston shafts of the plurality of pistons move along the track to move radially outward to discharge steam in the plurality of cylinders via the plurality of perorations.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
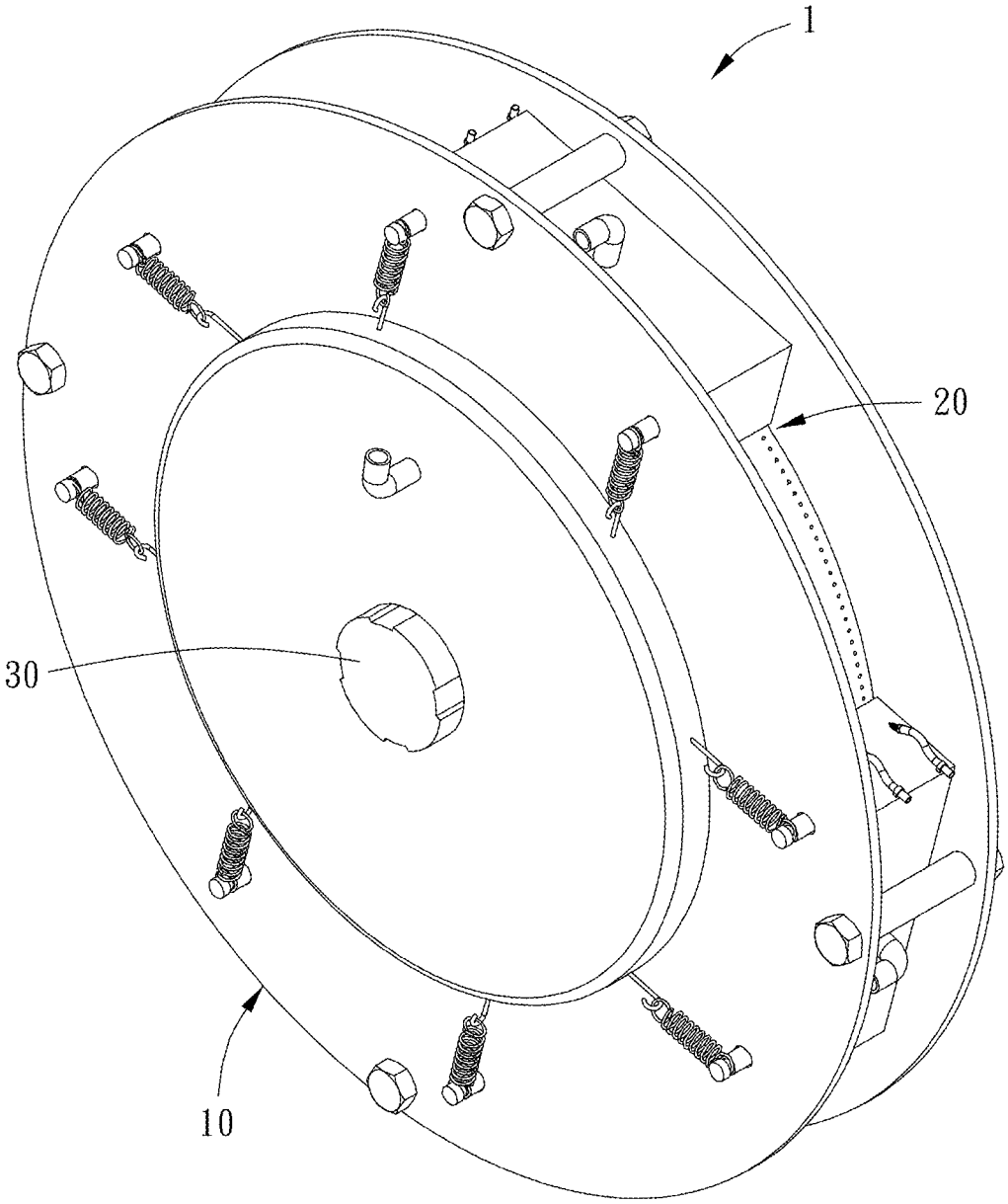
FIG. 1 is a perspective view of an exemplary embodiment of the present invention.
Figure 2:
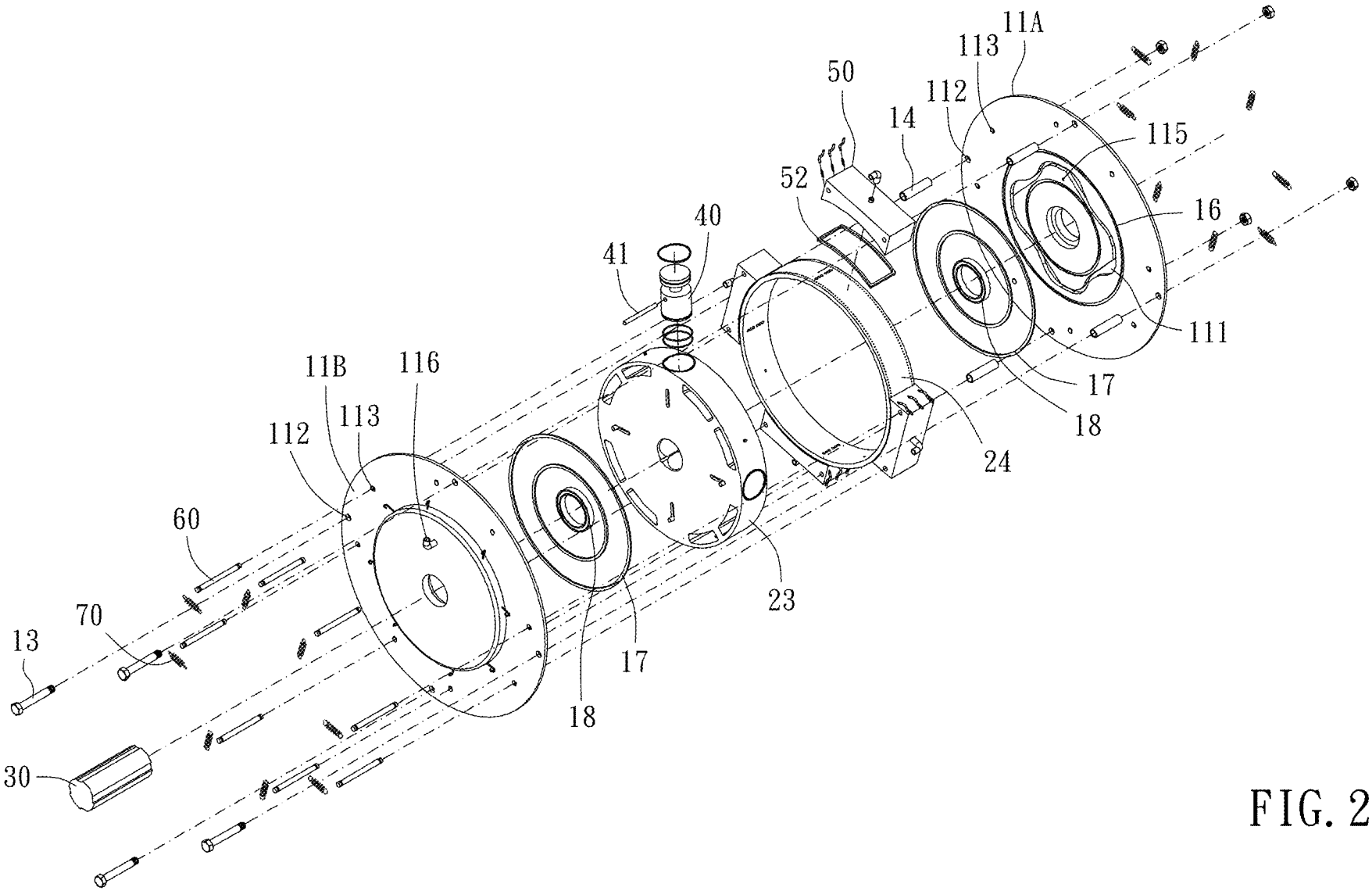
FIG. 2 is an exploded view of an exemplary embodiment of the present invention.
Figure 3:
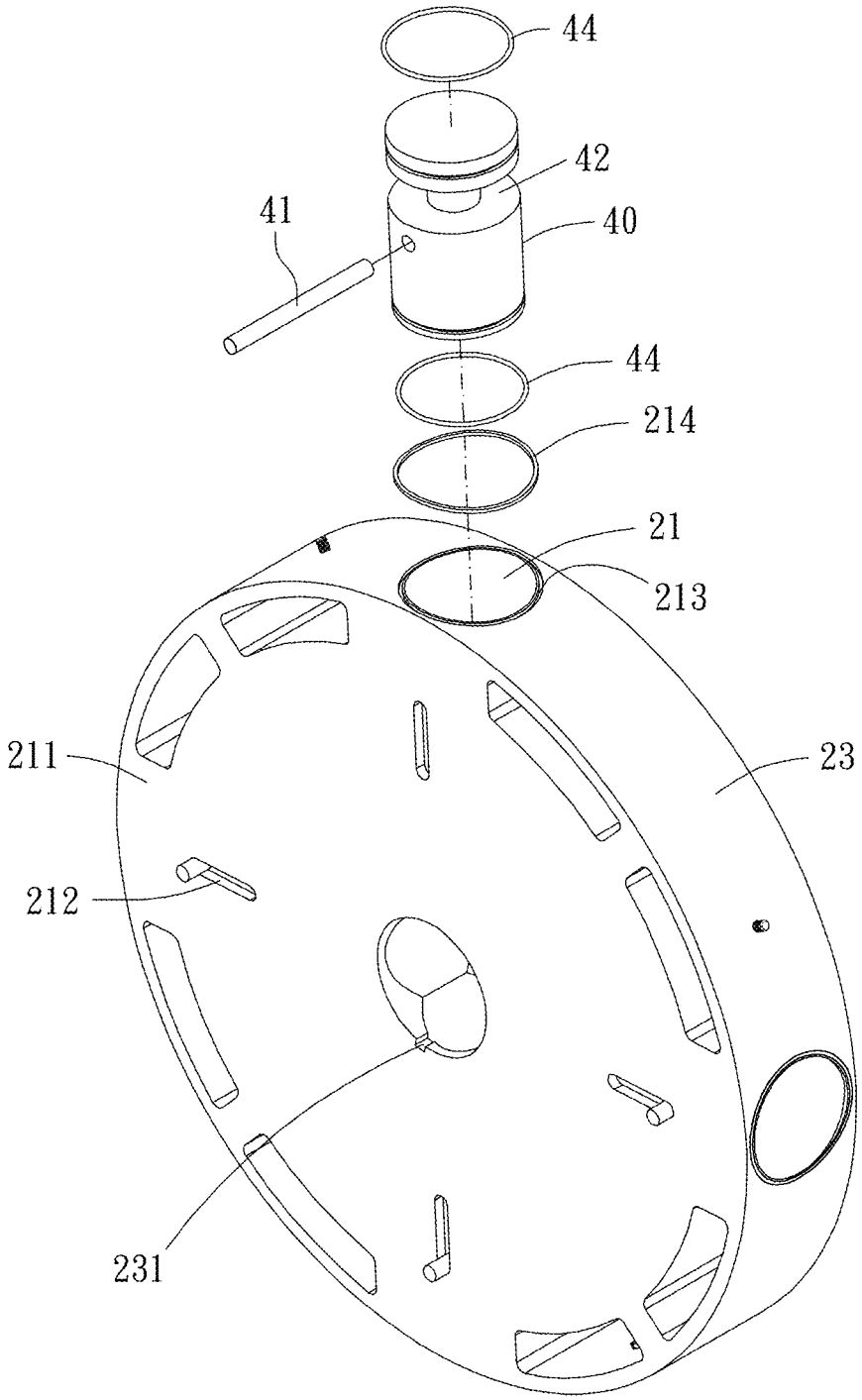
FIGS. 3 and 4 are exploded views of a rotor of an exemplary embodiment of the present invention.
Figure 4:
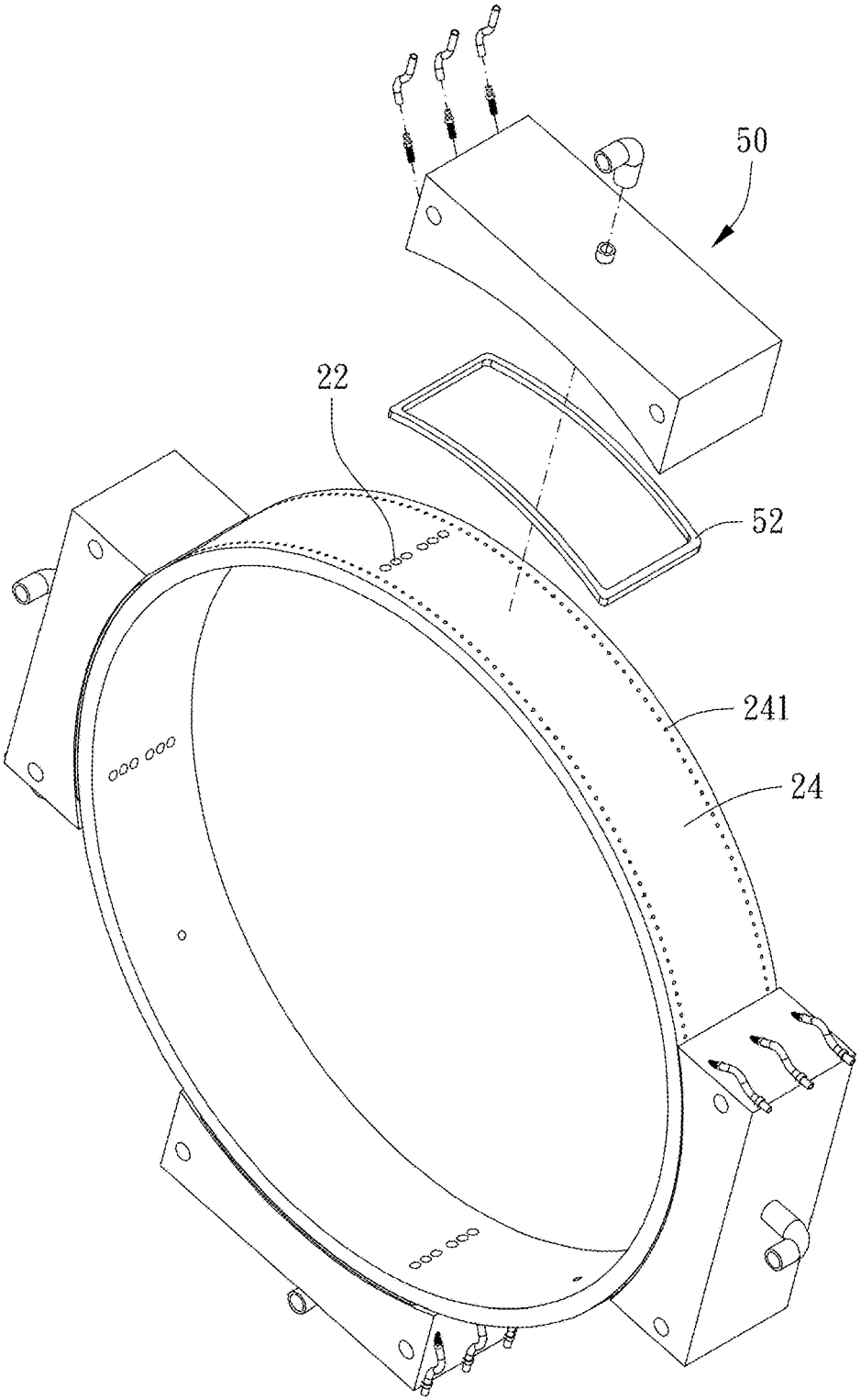
Figure 5:
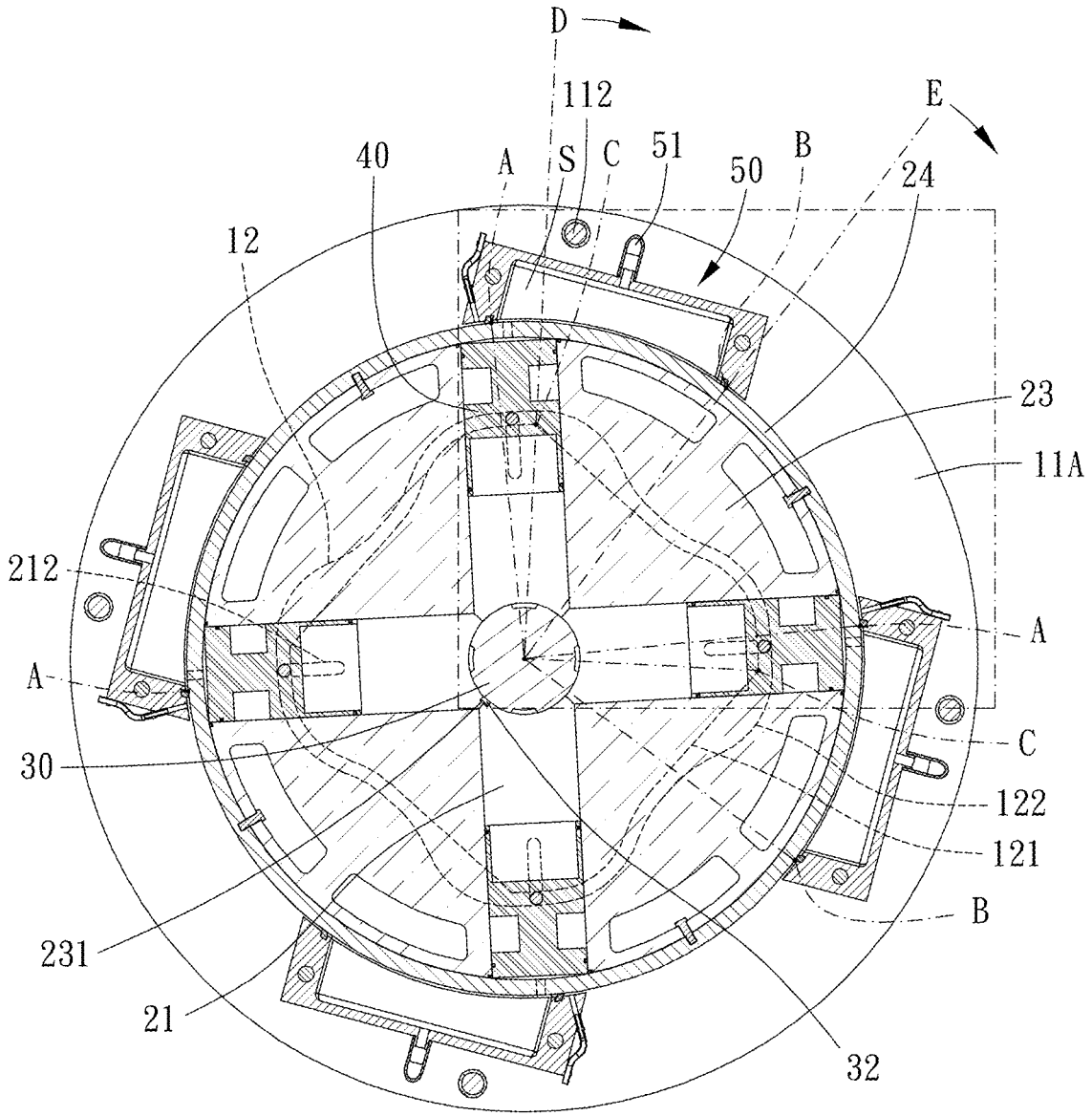
FIG. 5 is a cross-sectional view of an exemplary embodiment of the present invention.
Figure 6:
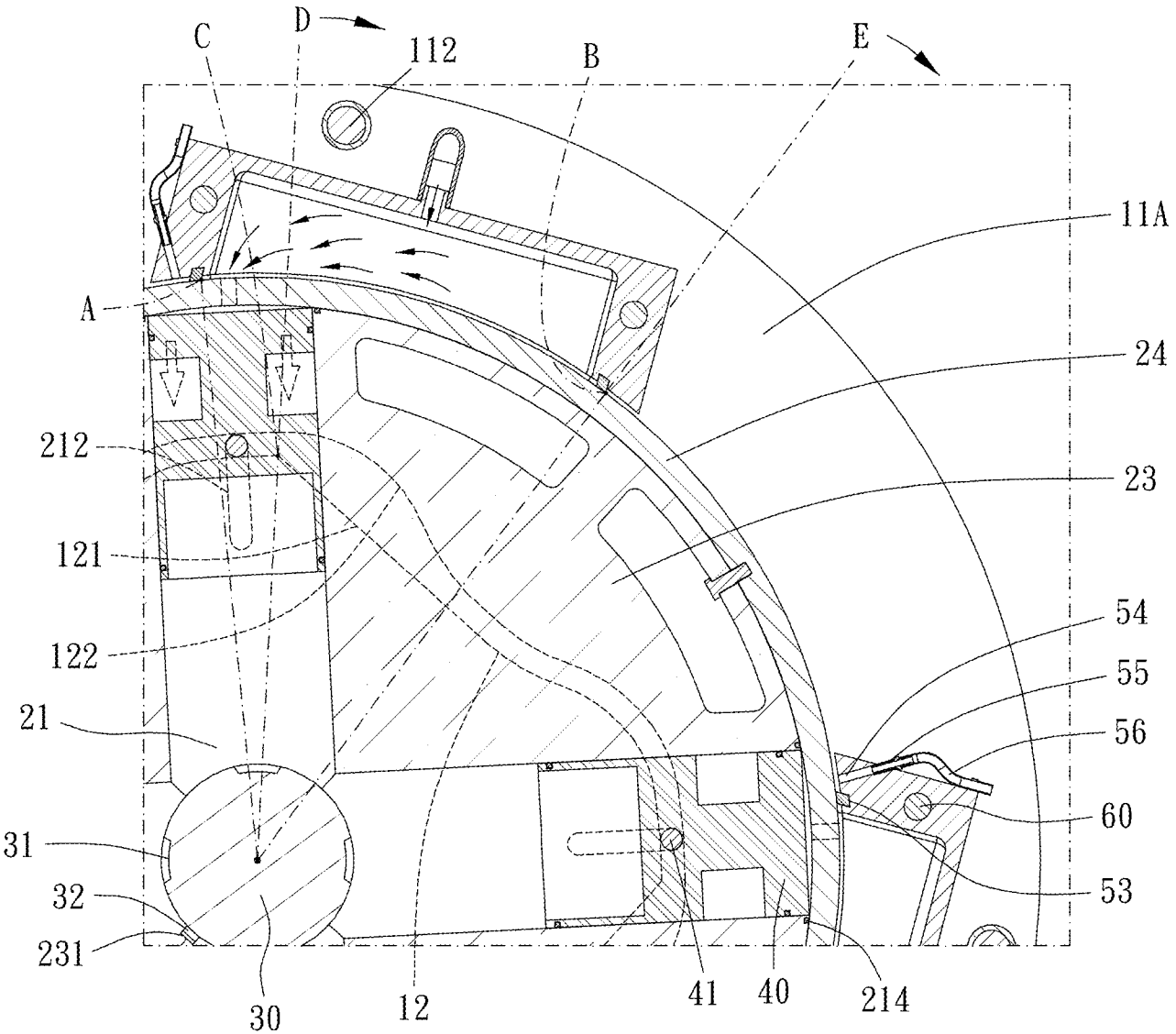
FIG. 6 is a partial enlarged view of FIG. 5.
Figure 7:
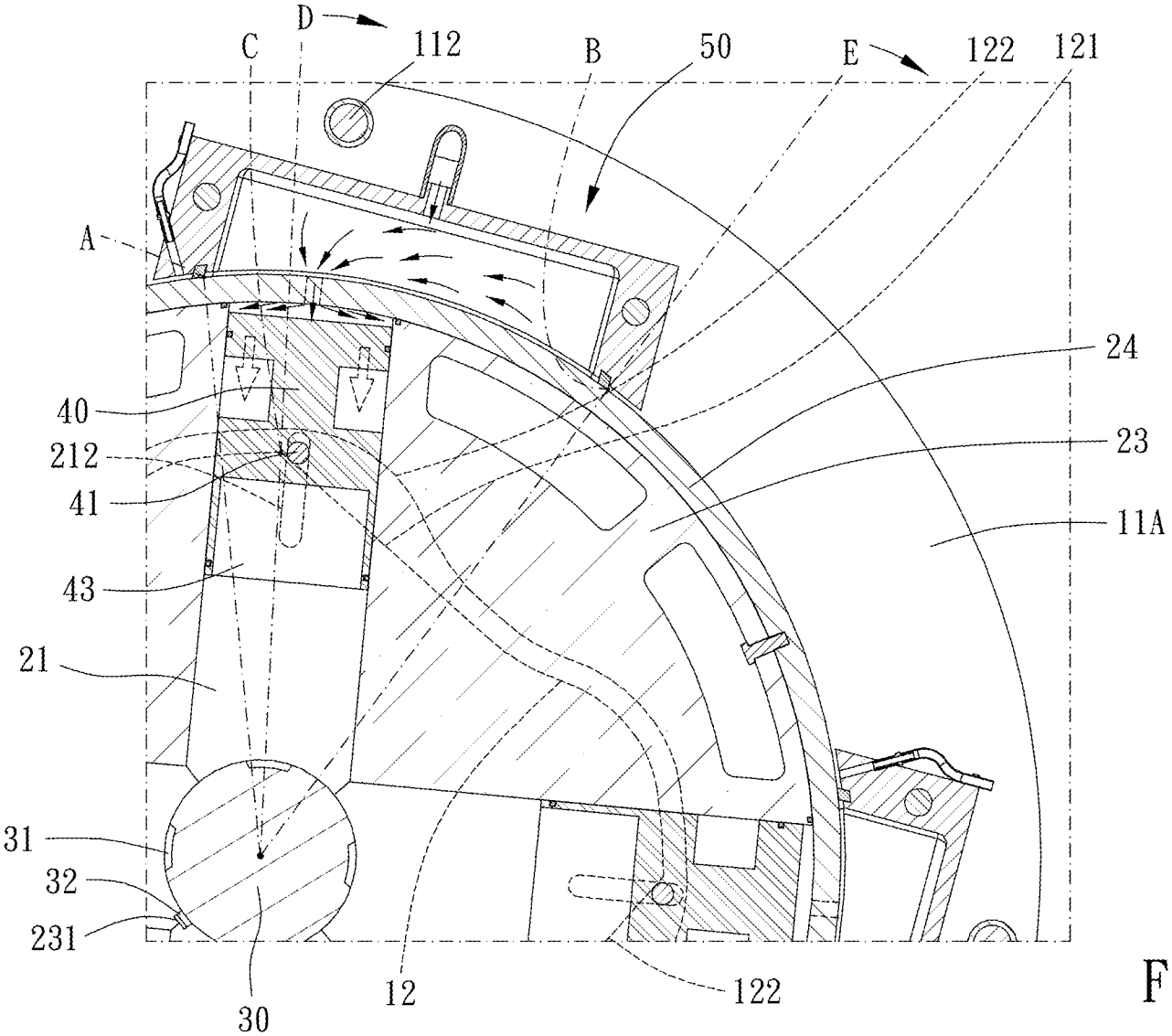
FIGS. 7 to 9 are schematic views showing operation of an exemplary embodiment of the present invention.
Figure 8:
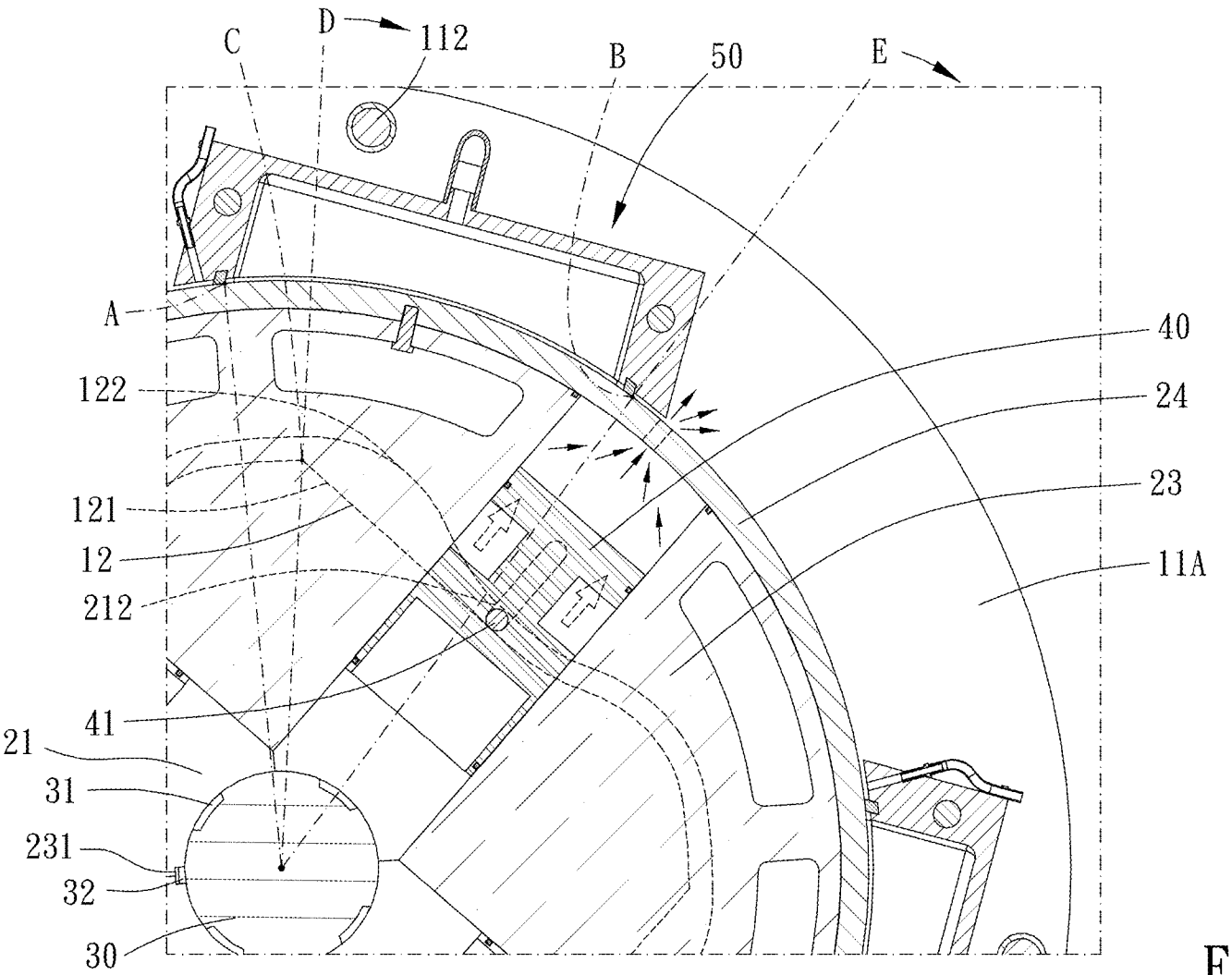
Figure 9:
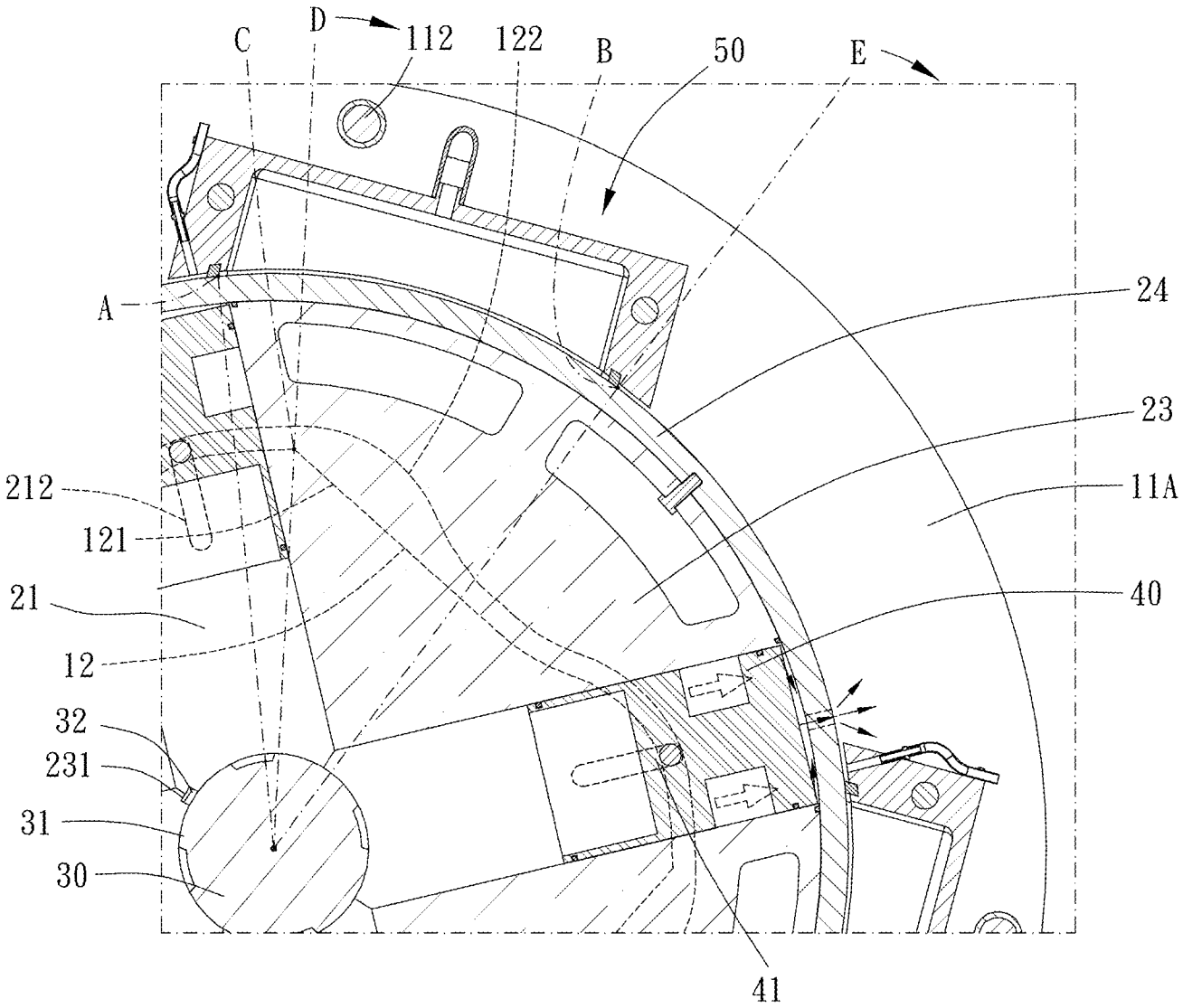
Figure 10:
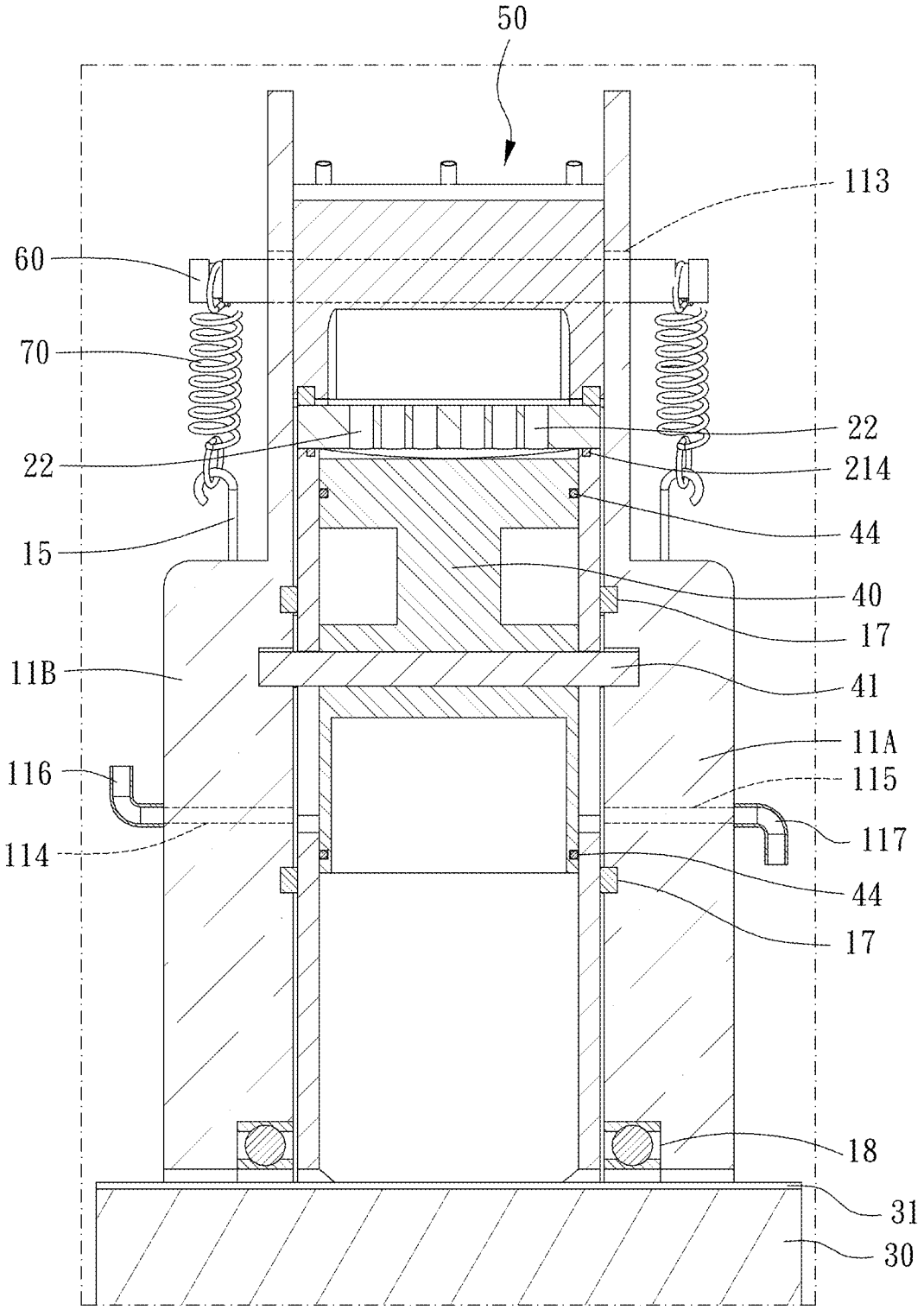
FIG. 10 is a partial sectional view of an exemplary embodiment of the present invention.
Figure 11:
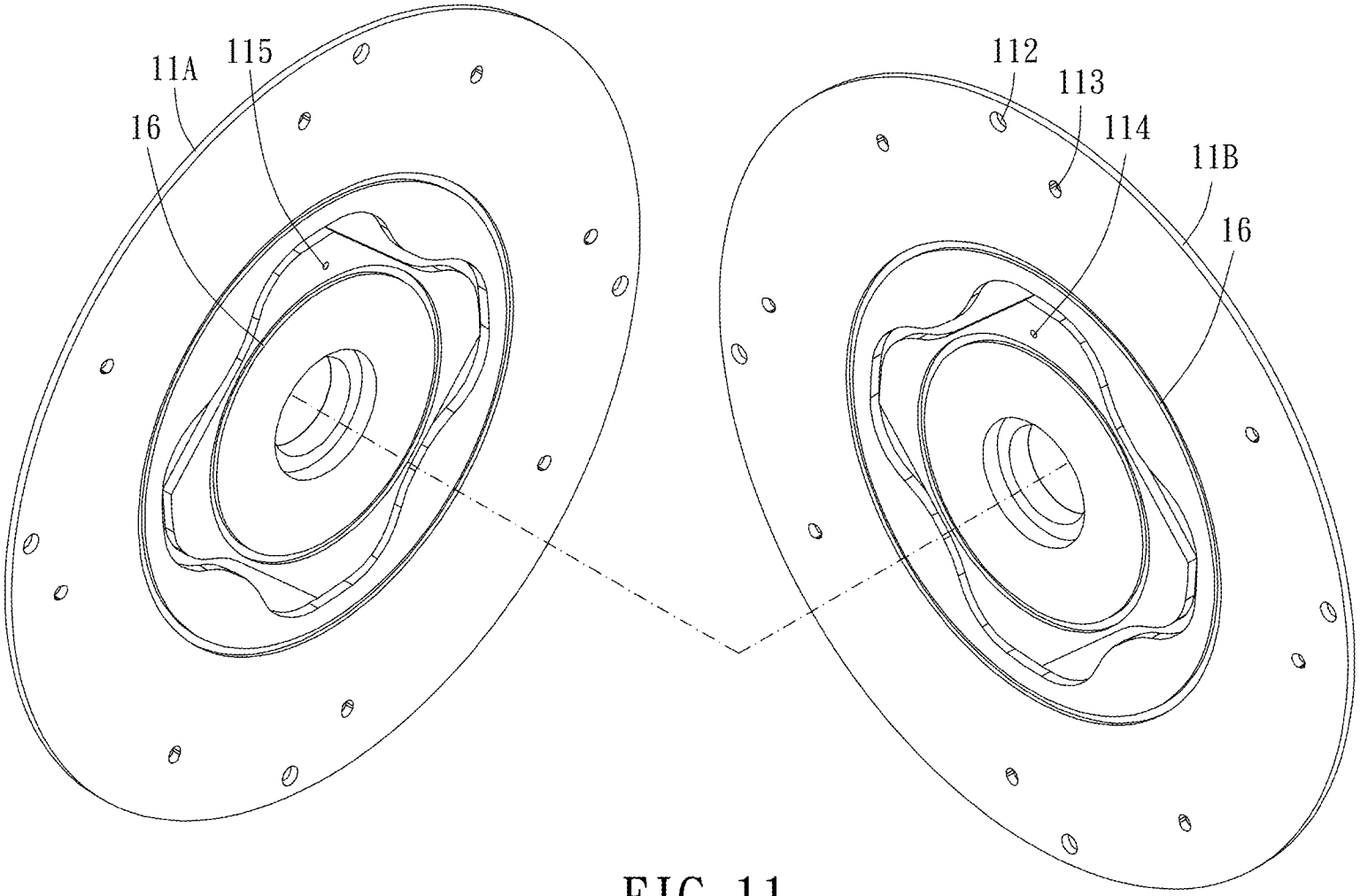
FIG. 11 is a schematic view of two stators of an exemplary embodiment of the present invention.

Please refer to FIGS. 1 to 11 for an exemplary embodiment of the present invention. A rotary steam engine 1 of the present invention includes a stator mechanism 10, a rotor 20, a mandrel 30, a plurality of pistons 40, and a plurality of gas covers 50.

The stator mechanism 10 includes two stators 11A, 11B and two stator seals 17. Each of the two stators 11A, 11B includes an annular guide groove 111 and two stator grooves 16 extending radially inside and outside the annular guide groove 111. The annular guide grooves 111 of the two stators 11A, 11B axially correspond to each other to form a track 12. The two stator seals 17 are embedded in and clamped between the stator grooves 16 of the two stators 11A, 11B. Two bearings 18 are assembled to central portions of the two stators 11A, 11B, respectively. The rotor 20 is rotatably arranged between the two stators 11A, 11B. The rotor 20 includes a plurality of cylinders 21 and a plurality of perforations 22. A cylinder wall 211 of each cylinder 21 includes a plurality of slots 212. The plurality of perforations 22 are open on an outer circumferential surface of the rotor 20 and respectively in communication with interiors of the plurality of cylinders 21. The mandrel 30 includes a plurality of axial ventilation grooves 31 corresponding to the plurality of cylinders 21 and disposed through the stator mechanism 10 and the rotor 20, and the mandrel 30 is movable with the rotor 20. Preferably, the rotor 20 further includes an engaging slot 231, the further mandrel 30 includes an engaging key 32 protrusive therefrom, and the engaging key 32 inserted in the engaging slot 231 so that the rotor 20 and the mandrel 30 are rotatable with each other. Each of the plurality of pistons 40 includes piston seals 44 at the upper and lower ends. The plurality of pistons 40 are respectively received in the plurality of cylinders 21. Each of the plurality of pistons 40 includes a piston shaft 41 which projects axially beyond one of the plurality of slots 212 and is movable along the track 12. A space in which each of the plurality of pistons 40 and the piston seal 44 are movable in the cylinder 21, a space between the two stator seals 17 of the stator mechanism 10 and the plurality of slots 212 are in communication with one another to form an engine lubricating system. The plurality of gas covers 50 are radially movable and resiliently disposed on the stator mechanism 10 and cover the outer circumferential surface of the rotor 20. A gas injection space S is formed between one of the plurality of gas covers and the outer circumferential surface of the rotor 20. Each of the plurality of gas covers 50 includes a gas supplying passage 51 in communication with the gas injection space S and configured for entering steam. When the gas injection space S is in communication with the plurality of perforations 22, the steam enters the gas injection space S via the gas supplying passage 51 of each of the plurality of gas covers 50 and enters the plurality of cylinders 21 via the plurality of perforations 22 to drive the plurality of pistons 40 to move radially inward so that the rotor 20 rotates relative to the stator mechanism 10. When the gas injection space S is not in communication with the plurality of perforations 22, the piston shafts 41 of the plurality of pistons 40 move along the track 12 to move radially outward to discharge steam in the plurality of cylinders 21 via the plurality of perforations 22.

When liquid water is heated to become steam at 100° C., its volume expands by approximately 1700 times. Utilizing this unique advantage as a power source makes it the most efficient when applied to engines. Each of the plurality of gas covers 50 can resiliently cover the outer circumferential surface of the rotor 20, minimizing steam leakage. The steam pressure in each of the plurality of gas covers 50 pushes the gas cover 50 outward, significantly reducing the frictional resistance between each of the plurality of gas covers 50 and the rotor 20 during operation. The frictional energy loss between mechanical components is extremely low, making the rotary steam engine highly efficient and providing the industry with a power source of very high thermal efficiency.

The stator mechanism 10 further includes a plurality of bolts 13 and a plurality of bolt sleeves 14. The two stators 11A, 11B each further include a plurality of through holes 112. The plurality of bolt sleeves 14 are abutted between the two stators 11A, 11B, and the plurality of bolts 13 are disposed through the plurality of through holes 112 of the two stators 11A, 11B and the plurality of bolt sleeves 14, thereby fixing the distance between the two stators 11. Additionally, when the plurality of bolts 13 pass through the plurality of through holes 112 of the two stators 11A, 11B, the annular guide grooves 111 of the two stators 11 align precisely to form a track and further serve to precisely position the plurality of gas covers 50.

The rotor 20 includes a rotor body 23 and an annular member 24 annularly disposed around the rotor body 23. The rotor body 23 includes the plurality of cylinders 21, and the annular member 24 includes the plurality of perforations 22 and can be regarded as equivalent to a cylinder head. This structural arrangement facilitates processing, manufacturing, and assembly. Specifically, an annular recess 213 is formed around a periphery of a top portion of each of the plurality of cylinders 21 and receives a seal ring 214 between the rotor body 23 and the annular member 24. The seal ring 214 seals the gap between the rotor body 23 and the annular member 24 so that the gas in the cylinder 21 cannot leak out from the gap during the power stroke. Preferably, the annular member 24 further includes a plurality of concavities 241 circumferentially arranged at intervals. Oil can be stored in the concavities 241 through the oil filling hole 54 of the gas cover, and the plurality of concavities 241 function as oil reservoirs, providing adequate lubrication between the gas cover seals 52 at the bottom of the gas cover 50 and the rotor 20. For instance, the plurality of concavities 241 (such as small round holes) are spaced every 3 mm along the sides of the annular member 24 where it contacts the plurality of gas covers 50. The depth of each concavity 241 is 1 mm; however, the shape, spacing and depth of each of the plurality of concavities 241 may vary according to different design requirements.

The stator 11B includes an oil inlet 114 which is connected to an oil inlet pipe 116 with an upward-facing opening. Because of the gravity, lubricant (oil) flows into the engine. The oil inlet 114 is located between the two stator seals 17 for injecting lubricant. The lubricant enters the cylinders 21 through the slots 212 and then moves between the stator 11A and the two stator seals 17. The stator 11A includes an oil outlet 115 connected to an oil outlet pipe 117 with a downward-facing opening, and the lubricant flows out of the rotary steam engine 1 through the oil outlet 115 of the stator 11A. This closed lubricating oil passage system ensures that the moving components of the rotary steam engine 1 are fully lubricated throughout the engine operation.

In this embodiment, the rotary steam engine 1 further includes a plurality of cover shafts 60 and a plurality of tension springs 70. The two stators 11 each further include a plurality of stator holes 113. The plurality of cover shafts 60 are radially movably disposed through the plurality of stator holes 113 respectively, and the plurality of tension springs 70 are connected between the stator mechanism 10 and the plurality of cover shafts 60 respectively. Specifically, each end of each tension spring 70 is hooked on one of the plurality of cover shafts 60, and a positioning hook 15 on the stator mechanism 10, and this allows each gas cover 50 to tend to move towards the outer circumferential surface of the rotor 20 when the steam pressure decreases, which prevents insufficient gas pressure.

In this embodiment, each stator hole 113 extends radially in the stator mechanism 10, and an annular end surface of each gas cover 50 includes a cover seal 52 which contacts the outer circumferential surface of the annular member 24 of the rotor. The cover seal 52 is partially firmly fixed in the cover groove 53 of one of the plurality of gas covers 50 using an adhesive material (e.g., strong adhesive). The high-pressure steam inside the gas cover 50 pushes the gas cover 50 outward, but the cover shafts 60 are constrained by the slightly elongated space of the stator holes 113. The diametric dimension of the stator hole 113 is larger than the outer diametric dimension of the cover shaft 60, preventing the high-pressure steam from completely escaping the restraint of each gas cover 50. Thus, during the operation of the rotary steam engine 1, an air cushion or air film forms between the cover seal 52 and the annular member 24, resulting in minimal frictional resistance.

Preferably, each gas cover 50 further includes at least one oil filling hole 54 facing the outer circumferential surface of the annular member 24 of the rotor. Each piston 40 includes an annular groove 42 for storing oil. Specifically, each gas cover 50 includes a plurality of oil filling holes 54 located outside the cover seal 52. Each oil filling hole 54 is connected to an oil source through a nozzle 55 via a pipe 56. When each piston 40 moves in the cylinder 21, oil is present in the annular groove 42 of each piston 40, which provides ample lubrication and effective heat dissipation. Additionally, the bottom of each piston 40 includes a chamber 43, which effectively reduces weight.

When the concavities 241 of the annular member 24 pass the opening of the oil filling hole 54, oil enters the concavities 241, keeping the cover seal 52 lubricated during operation, thus reducing frictional resistance and wear. The concavities 241 are small, and the cover seal 52 are flattened and widened when compressed so that the cover seal 52 can cover the concavities 241, prevent oil leakage and ensure long-lasting lubrication.

Figure 12:
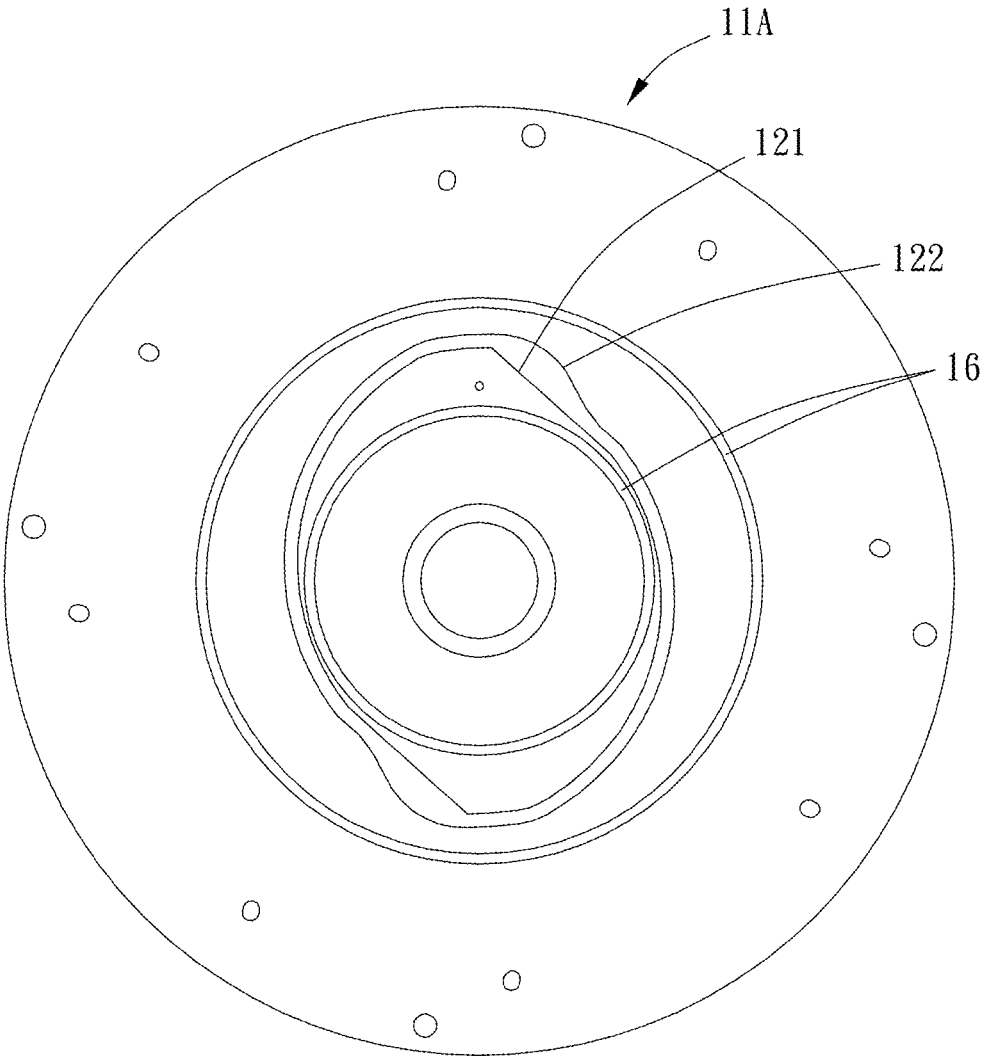
FIGS. 12 and 13 are schematic views tracks of stators with different numbers of strokes according to an exemplary embodiment of the present invention
Figure 13:
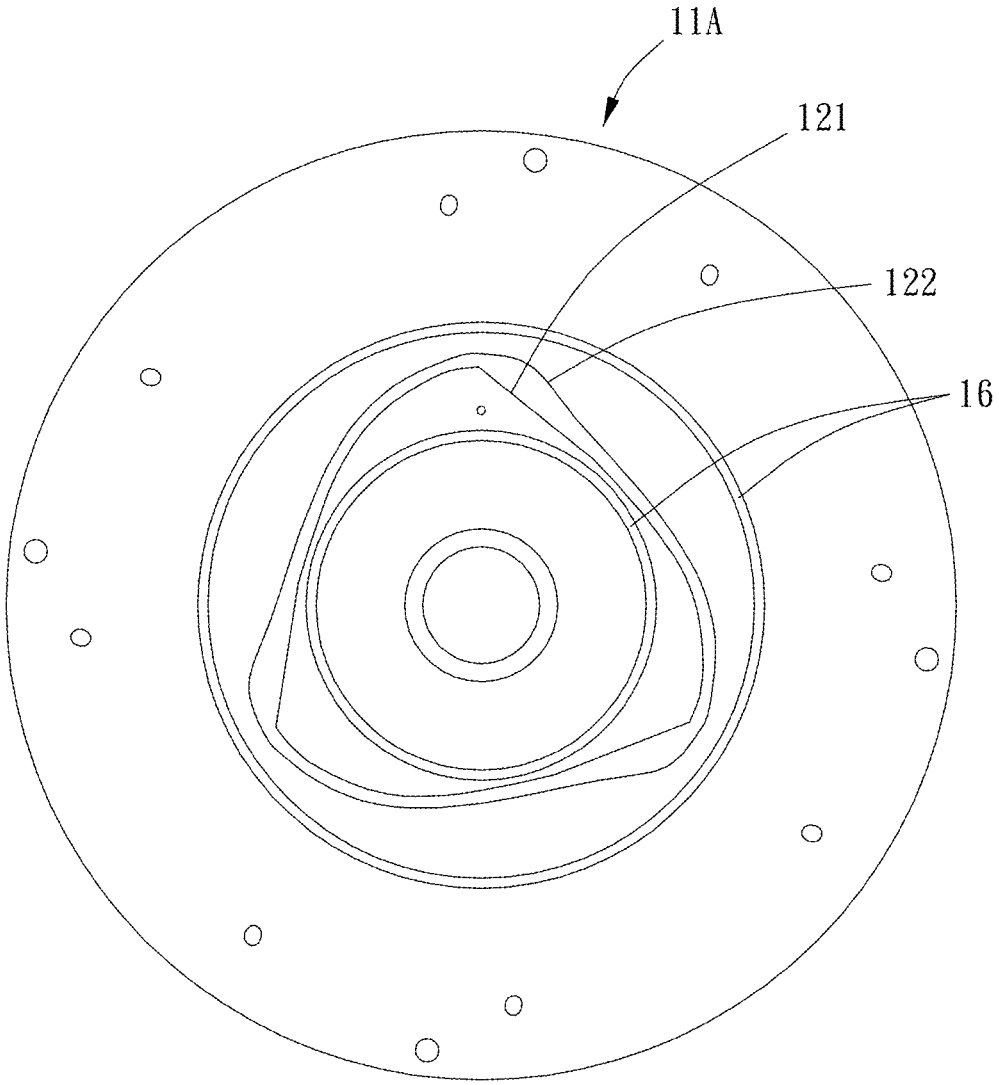

In this embodiment, the track 12 includes four identical strokes within 360 degrees, allowing the mandrel 30 to be driven by four power strokes simultaneously during rotation. However, the track 12 may include two or three identical strokes within 360 degrees (as shown in FIGS. 12 and 13) or other numbers of strokes.

The operation of the rotary steam engine 1 is described as follows. When each cover shaft 60 of the rotor 20 is in the radial position corresponding to the starting point C of the power stroke of the track 12, steam begins to enter the gas cover 50 at the advance point A before the starting point C of the power stroke. At this point, the piston 40 is constrained by the track 12 and does not move. Only when the plurality of perforations 22 move to the starting point C of the power stroke along the track 12 and start to descend, the cylinders 21 are driven by the steam, so the stroke from the advance point A to the starting point C of the power stroke is not counted as a power stroke; it merely allows the cylinders 21 to pre-compress. When the plurality of perforations 22 move to the exhaust point B, the steam in the cylinders 21 begins to exhaust via the plurality of perforations 22.

Specifically, during the descent movement of the piston 40 along the track 12, if the air pressure inside the gas cover 50 is sufficient to push the piston 40, the piston shaft 41 slides along the inner side 121 of the track during the power stroke. If the air pressure inside the gas cover 50 is insufficient to push the piston 40 downward (e.g., engine shutdown), the piston shaft 41 moves along the outer side 122 of the track during the power stroke under the action of centrifugal force.

The ventilation groove 31 is in communication with each of the cylinders 21. When the engine is running, as the piston 40 moves radially downward, the air below the piston 40 is discharged through the ventilation groove 31. When the piston 40 moves radially upward, external air enters each of the cylinders 21 through the ventilation groove 31.

The rotary steam engine 1 of the present invention can not only be used as an industrial power source but also can utilize solar hot water equipment to heat cold water into high-temperature hot water, or use geothermal sources which produce an endless supply of high-temperature water. Through heat exchange, non-corrosive water can be converted into high-temperature hot water and introduced into a boiler, so that the boiler only needs to be slightly heated to bring the hot water to 100 degrees Celsius, at which point the hot water can be vaporized to produce high-pressure steam. The steam can be directed through the steam pipe into the gas cover 50 to drive the rotary steam engine 1 of the present invention to generate electricity, thereby creating an extremely low-cost power source. Furthermore, since only a closed space can fully utilize the pressure generated by the significant expansion of the steam and since the rotary steam engine uses steam in a closed manner, the thermal efficiency of the steam engine will be greatly improved, thus providing an optimal solution for energy needs for human.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A rotary steam engine including:

a stator mechanism including two stators and two stator seals, each of the two stators including an annular guide groove and two stator grooves extending radially inside and outside the annular guide groove, the annular guide grooves of the two stators axially corresponding to each other to form a track, the two stator seals being embedded in and clamped between the stator grooves of the two stators;

a rotor rotatably arranged between the two stators and including a plurality of cylinders and a plurality of perorations, a cylinder wall of each cylinder including a plurality of slots, the plurality of perorations being open on an outer circumferential surface of the rotor and respectively in communication with interiors of the plurality of cylinders;

a mandrel including a plurality of axial ventilation grooves corresponding to the plurality of cylinders, disposed through the stator mechanism and the rotor, and movable with the rotor;

a plurality of pistons, each of upper and lower ends of each of the plurality of pistons including a piston seal, the plurality of pistons being respectively received in the plurality of cylinders and respectively including piston shafts which project axially beyond the plurality of slots and are movable along the track, a space in which each of the plurality of pistons and the piston seal are movable in the cylinder, a space between the two stator seals of the stator mechanism and the plurality of slots being in communication with one another to form an engine lubricating system; and a plurality of gas covers radially movable respectively, resiliently disposed on the stator mechanism and covered on an outer circumferential surface of the rotor, a gas injection space being formed between each gas cover and the outer circumferential surface of the rotor, each of the plurality of gas covers including a gas supplying passage in communication with the gas injection space and configured for entering steam;

wherein when the gas injection space is in communication with the plurality of perorations, the steam enters the gas injection space via the gas supplying passage of each of the plurality of gas covers and enters the plurality of cylinders via the plurality of perorations to drive the plurality of pistons to move radially inward so that the rotor rotates relative to the stator mechanism;

wherein when the gas injection space is not in communication with the plurality of perorations, the piston shafts of the plurality of pistons move along the track to move radially outward to discharge steam in the plurality of cylinders via the plurality of perorations.

2. The rotary steam engine of claim 1, wherein the stator mechanism further includes a plurality of bolts and a plurality of bolt sleeves, the two stators each further include a plurality of through holes, the plurality of bolt sleeves are abutted between the two stators, and the plurality of bolts are disposed through the plurality of through holes of the two stators and the plurality of bolt sleeves.

3. The rotary steam engine of claim 1, wherein the rotor includes a rotor body and an annular member annularly disposed around the rotor body, the rotor body includes the plurality of cylinders, the annular member includes the plurality of perforations, and an annular recess is formed around a periphery of a top portion of each of the plurality of cylinders and receives a seal ring between the rotor body and the annular member.

4. The rotary steam engine of claim 3, wherein the annular member further includes a plurality of concavities circumferentially arranged at intervals.

5. The rotary steam engine of claim 1, further including a plurality of cover shafts and a plurality of tension springs, wherein the two stators each further include a plurality of stator holes, the plurality of cover shafts are radially movably disposed in the plurality of stator holes respectively, and the plurality of tension springs are connected between the stator mechanism and the plurality of cover shafts respectively.

6. The rotary steam engine of claim 5, wherein each of the plurality of stator holes extends radially in the stator mechanism.

7. The rotary steam engine of claim 1, wherein each of the plurality of pistons includes an annular groove for storing oil.

8. The rotary steam engine of claim 1, wherein each of the covers further includes at least one oil filling hole facing the outer circumferential surface of the rotor.

9. The rotary steam engine of claim 1, wherein an annular end surface of each of the plurality of gas covers further includes a cover seal, and the cover seal contacts the outer circumferential surface of the rotor.

* * * * *